US008092179B2

(12) United States Patent
Paauwe et al.

(10) Patent No.: US 8,092,179 B2
(45) Date of Patent: Jan. 10, 2012

(54) BLADE TIP COOLING GROOVE

(75) Inventors: Corneil S. Paauwe, Manchester, CT (US); Brandon W. Spangler, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 408 days.

(21) Appl. No.: 12/402,571

(22) Filed: Mar. 12, 2009

(65) Prior Publication Data

US 2010/0232979 A1 Sep. 16, 2010

(51) Int. Cl.
*F01D 5/08* (2006.01)
*F01D 5/20* (2006.01)

(52) U.S. Cl. ... 416/97 R; 415/115; 415/116; 415/170.1; 415/173.1; 415/173.4; 416/92; 416/95; 416/96 R; 416/228; 416/236 R

(58) Field of Classification Search ..... 415/115, 415/116, 170.1, 173.1, 173.4; 416/92, 95, 416/96 R, 97 R, 228, 236 R
See application file for complete search history.

(56) References Cited

U.S. PATENT DOCUMENTS 5,261,789 A * 11/1993 Butts et al. ..... 416/96 R
5,503,527 A 4/1996 Lee et al.
5,927,946 A * 7/1999 Lee ..... 416/97 R
6,382,913 B1 * 5/2002 Lee et al. ..... 416/96 R
6,422,821 B1 * 7/2002 Lee et al. ..... 416/224
6,554,575 B2 4/2003 Leeke et al.
6,652,235 B1 11/2003 Keith et al.
6,790,005 B2 9/2004 Lee et al.
6,824,359 B2 11/2004 Chlus et al.
7,059,834 B2 6/2006 Chlus et al.
7,118,337 B2 10/2006 Liang
7,175,391 B2 2/2007 Chlus et al.
7,300,250 B2 11/2007 Papple
2003/0059304 A1 * 3/2003 Leeke et al. ..... 416/97 R
2003/0223870 A1 * 12/2003 Keith et al. ..... 416/97 R
2004/0013515 A1 * 1/2004 Cherry et al. ..... 415/115
2004/0197190 A1 * 10/2004 Stec et al. ..... 416/97 R
2006/0088420 A1 * 4/2006 Lee ..... 416/235
2008/0131278 A1 * 6/2008 Correia et al. ..... 416/23

* cited by examiner

*Primary Examiner* — Asok Sarkar
(74) *Attorney, Agent, or Firm* — Calrson Gaskey & Olds, P.C.

(57) ABSTRACT

An example turbine blade includes a blade having an airfoil profile extending radially toward a blade tip. A shelf is established in the blade tip. A sealing portion of the blade tip extends radially past a floor of the shelf. The sealing portion extends from a blade tip leading edge to a blade tip trailing edge. A groove is established in the blade tip. The groove extends from adjacent the shelf to adjacent the blade tip trailing edge. The groove is configured to communicate a fluid from a position adjacent the shelf to a position adjacent the blade tip trailing edge.

20 Claims, 3 Drawing Sheets

BLADE TIP COOLING GROOVE

BACKGROUND

This application relates to communicating fluid through a groove to cool a blade tip.

Gas turbine engines are known and typically include multiple sections, such as a fan section, a compression section, a combustor section, a turbine section, and an exhaust nozzle section. Blades within the compressor and turbine sections are often mounted for rotation about an axis. The blades have airfoils extending radially from a mounting platform toward a blade tip.

Rotating blades compress air in the compression section. The compressed air mixes with fuel and is combusted in the combustor section. Products of the combustion expand to rotatably drive blades in the turbine section. As known, blades are often exposed to extreme temperatures. Some blades include internal features, such as channels, for routing cooling air. Some blades include external features, such as blade shelves, for routing cooling air.

Referring to prior art FIGS. 1-4, a prior art blade tip 10 includes a blade shelf 14 having a shelf floor 18 that is radially spaced from a sealing surface 22. The blade shelf 14 distributes cooling airflow from holes 26 to some areas of the blade tip 10. The sealing surface 22 contacts another portion of the engine (not shown) to create a seal that facilitates work extraction. As known, regions near a trailing edge 30 of the blade tip 10 experience significant distress over time due to ineffective distribution of cooling airflow from the holes 26 to these regions. In a prior art blade tip 10*a*, the blade shelf 14*a* extends to a trailing edge 30*a* of the blade tip 10*a*. As known, the blade shelf 14*a* extending to the trailing edge 30*a* weakens the blade tip 10*a* and significantly decreases the sealing surface, which degrades performance of the engine.

SUMMARY

An example turbine blade includes a blade having an airfoil profile extending radially toward a blade tip. A shelf is established in the blade tip. A sealing portion of the blade tip extends radially past a floor of the shelf. The sealing portion extends from a blade tip leading edge to a blade tip trailing edge. A groove is established in the blade tip. The groove extends from adjacent the shelf to adjacent the blade tip trailing edge. The groove is configured to communicate a fluid from a position adjacent the shelf to a position adjacent the blade tip trailing edge.

Another example turbine blade includes a blade tip having a suction side and a pressure side. The blade tip extends from a leading edge portion of a blade to a trailing edge portion of the blade. A shelf is established in the pressure side of the blade tip. A groove is established in the blade tip. The groove is configured to communicate fluid from the shelf to the trailing edge portion of the blade.

An example method of cooling a blade includes communicating a fluid through a blade to a blade shelf near a tip of the blade, moving a portion of the fluid across a portion of a blade tip sealing surface that extends from a blade tip leading edge to a blade tip trailing edge, and communicating another portion of the fluid from the blade shelf to a blade tip trailing edge within a groove that is established in the blade tip.

These and other features of the example disclosure can be best understood from the following specification and drawings, the following of which is a brief description:

DETAILED DESCRIPTION

Figure 1:
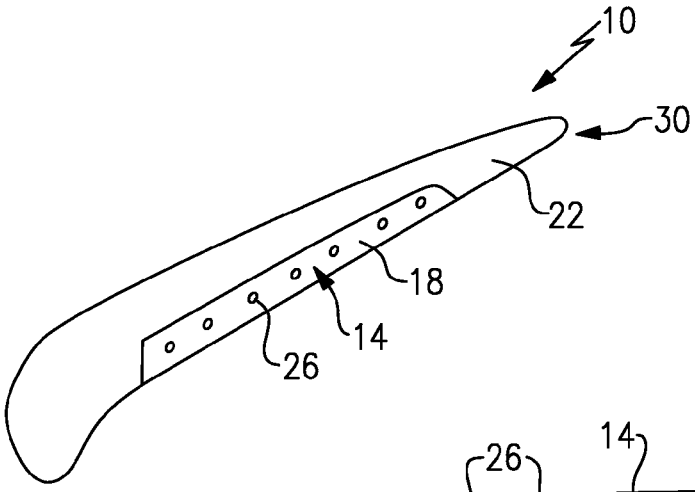
FIG.1 Prior Art
FIG. 1 shows an end view of a prior art blade tip.
Figure 2:
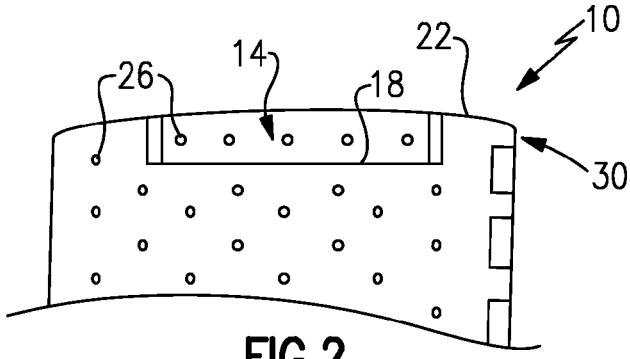
FIG.2 Prior Art
FIG. 2 shows a side view of the FIG. 1 prior art blade tip.
Figure 3:
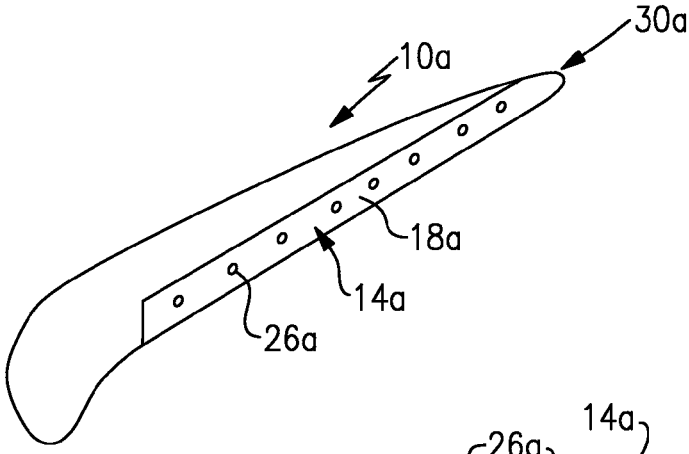
FIG.3 Prior Art
FIG. 3 shows an end view of another prior art blade tip.
Figure 4:
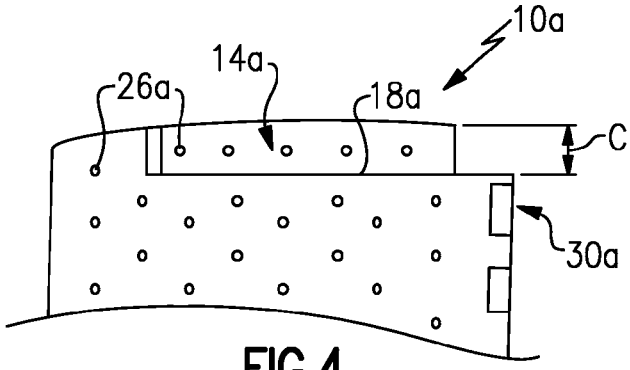
FIG.4 Prior Art
FIG. 4 shows a side view of the FIG. 3 prior art blade tip.
Figure 5:
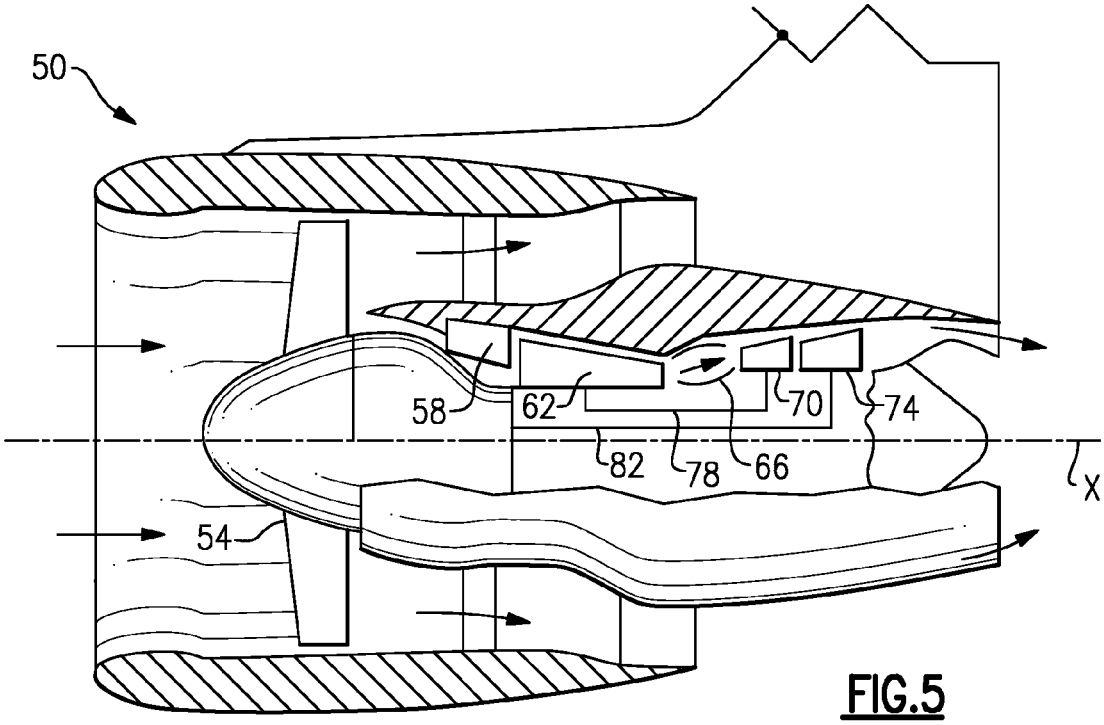
FIG. 5 schematically shows an example gas turbine engine.
Figure 6:
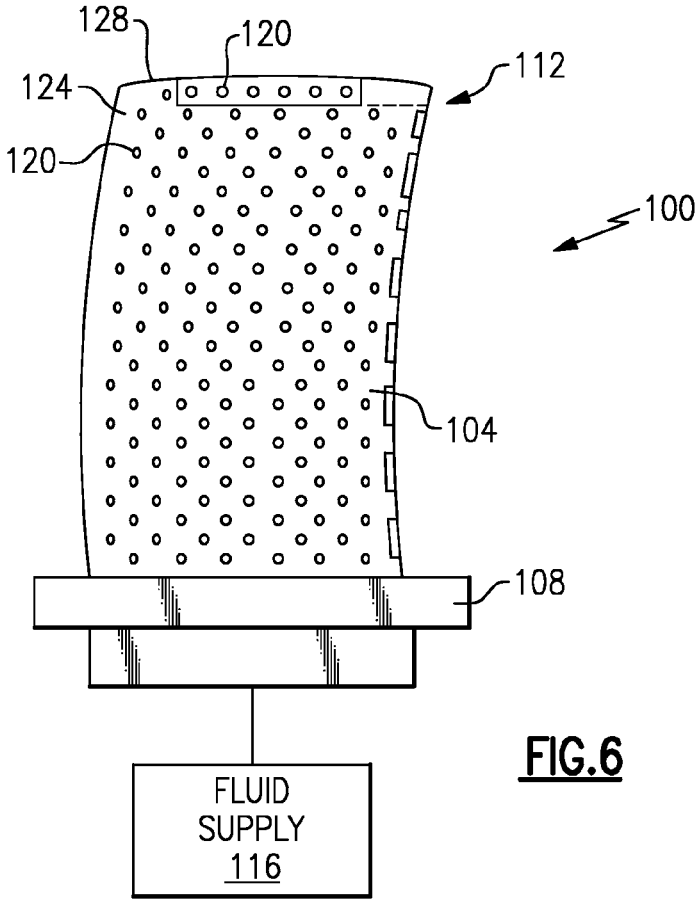
FIG. 6 shows a partial schematic side view of an example blade of the FIG. 5 engine.
Figure 7:
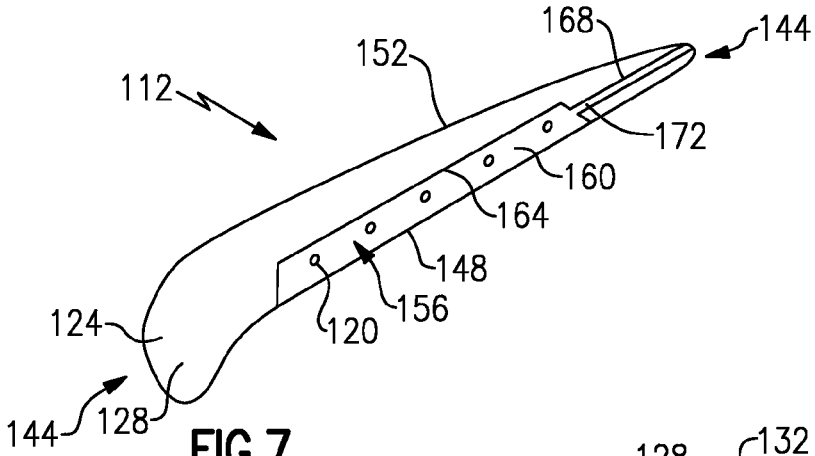
FIG. 7 shows an end view of the tip of the FIG. 6 blade.
Figure 8:
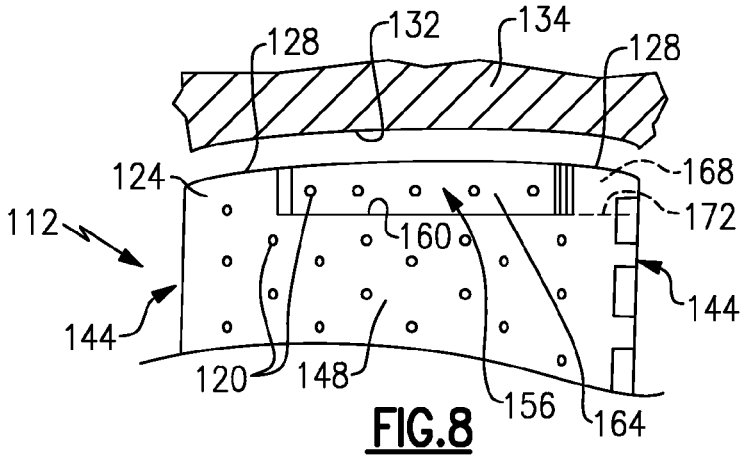
FIG. 8 shows a side view of the tip of the FIG. 6 blade.
Figure 9:
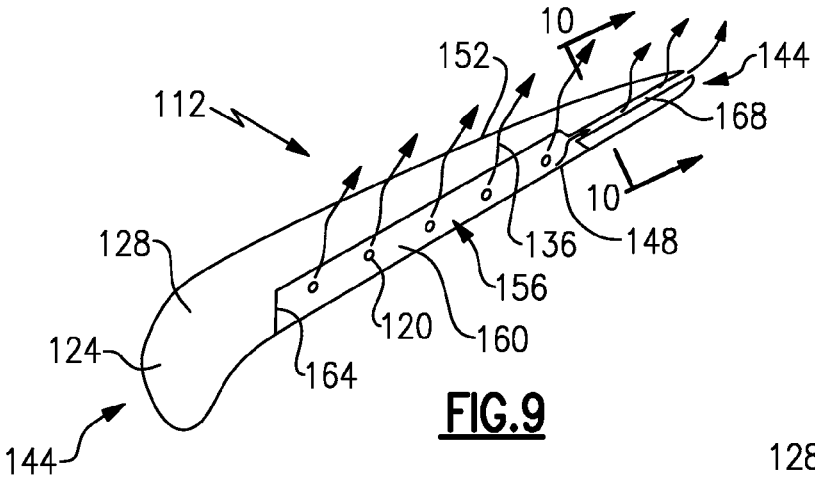
FIG. 9 shows the paths of a cooling fluid from tip of the FIG. 6 blade.
Figure 10:
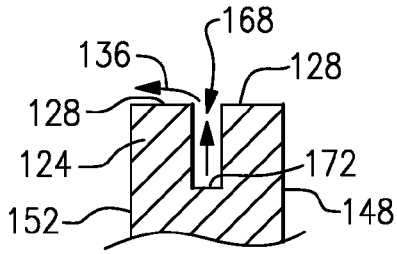
FIG. 10 shows a section view of a grooved portion of the FIG. 6 blade.

FIG. 5 schematically illustrates an example gas turbine engine 50 including (in serial flow communication) a fan section 54, a low-pressure compressor 58, a high-pressure compressor 62, a combustor 66, a high-pressure turbine 70, and a low-pressure turbine 74. The gas turbine engine 50 is circumferentially disposed about an engine centerline X. During operation, air is pulled into the gas turbine engine 50 by the fan section 54, pressurized by the compressors 58 and 62, mixed with fuel, and burned in the combustor 66. The high and low-pressure turbines 70 and 74 extract energy from the hot combustion gases flowing from the combustor 66.

In a two-spool design, the high-pressure turbine 70 utilizes the extracted energy from the hot combustion gases to power the high-pressure compressor 62 through a high speed shaft 78, and the low-pressure turbine 74 utilizes the energy extracted from the hot combustion gases to power the low-pressure compressor 58 and the fan section 54 through a low speed shaft 82. The examples described in this disclosure are not limited to the two-spool engine architecture described however, and may be used with other architectures, such as a single-spool axial design, a three-spool axial design, and still other architectures. That is, there are various types of engines that could benefit from the examples disclosed herein, which are not limited to the design shown.

Referring now to FIGS. 6-10 with continuing reference to FIG. 5, an example blade 100 from the high-pressure turbine 70 includes an airfoil profile 104 radially extending from a base 108 to a blade tip 112. A fluid 136, such as air, communicates from a fluid supply 116 through an interior of the blade 100 and exits at a plurality of exit holes 120 established by the blade 100.

The blade tip 112 includes a sealing portion 124 having a sealing surface 128 that is operative to seal against another portion of the gas turbine engine 50, such as a surface 132 of a blade outer air seal 134. In one example, portions of the sealing surface 128 contact the blade outer air seal 134 to provide a seal. Other portions of the sealing surface 128 are spaced from the blade outer air seal 134 approximately 0.508 to 0.762 mm and rely in part on the fluid 136 to provide the seal. The fluid 136 cools the blade tip 112 and facilitates maintaining a seal between the sealing surface 128 and the surface 132 as the high-pressure turbine 70 operates.

In this example, the sealing portion 124 and the sealing surface 128 extend axially from a leading edge 140 of the blade 100 to a trailing edge 144 of the blade 100. The sealing portion 124 and the sealing surface 128 also extend from a pressure side 148 of the blade 100 to a suction side 152 of the blade 100.

In this example, the blade tip 112 establishes a shelf 156 having a shelf floor 160 that is radially spaced from the sealing surface 128, such that the sealing surface 128 is further from the engine centerline X than the shelf floor 160. A plurality of shelf walls 164 span between the shelf floor 160 and the sealing surface 128. The shelf floor 160 and the shelf walls 164 both include some of the exit holes 120 in this example. In other examples the shelf floor 160 or the shelf walls 164 lack the exit holes 120.

The example sealing portion 124 establishes a groove 168 that extends axially from the shelf 156 to the trailing edge 144 of the blade 100. The sealing portion 124 is generally defined as the portion of the blade tip 112 extending radially past the shelf floor 160. The groove 168 radially terminates at a groove floor 172 that is aligned with the shelf floor 160 in this example. The example groove 168 has a rectangular cross-section in this example and is generally aligned with a portion of the pressure side 148. A machining operation, such as an Electrical Discharge Machining, is used to form the groove 168 in one example.

Some of the fluid 136 flowing from the exit holes 120, particularly the exit holes 120 established within the shelf floor 160 and the shelf wall 164, communicates through the groove 168 to a position adjacent the trailing edge 144 of the blade 100. The fluid 136 exiting the groove 168 near the trailing edge 144 of the blade 100 cools the trailing edge 144 of the blade 100. Some of the fluid 136 communicating through the groove 168 also moves out of the groove 168 prior to reaching the trailing edge 144. This portion of the fluid 136 flows over the portions of the sealing surface 128 near the groove 168 to facilitate cooling this area of the blade tip 112. In one example, about 60% of the fluid 136 that enters the groove 168 exits at the trailing edge 144 of the blade 100, and about 40% of the fluid 136 that enters the groove 168 flows radially out of the groove 168 and over a portion of the sealing surface 128.

The example shelf 156 is established on the pressure side 148 of the blade 100, and the width of the shelf 156 is greater than the width of the groove 168. In one example, the width of the groove is between 0.254-0.508 mm, which is approximately the diameter of the exit holes 120. The radial depth of the example shelf is between 0.762-1.270 mm. Although the groove floor 172 is aligned generally with the shelf floor 160, other examples may include different sizes of the groove 168 and different relationships between the groove 168 and the shelf 156. The groove 168 does not include exit holes 120 in this example, but other examples may.

Features of this invention include cooling a trailing edge of a blade tip while maintaining the structural integrity of the blade tip and engine compression efficiencies.

Although a preferred embodiment has been disclosed, a worker of ordinary skill in this art would recognize that certain modifications would come within the scope of this invention. For that reason, the following claims should be studied to determine the true scope and content of this invention.

We claim:

1. A turbine blade, comprising:

a blade having an airfoil profile extending radially toward a blade tip;

a shelf established in the blade tip, the shelf opening to a circumferential side of the blade;

a sealing portion of the blade tip extending radially past a floor of the shelf the sealing portion extending from a blade tip leading edge to a blade tip trailing edge; and a groove established in the blade tip, the groove extending from adjacent the shelf to adjacent the blade tip trailing edge, the groove configured to communicate a fluid from a position adjacent the shelf to a position adjacent the blade tip trailing edge.

2. The turbine blade of claim 1, wherein a floor of the groove is radially aligned with the floor of the shelf.

3. The turbine blade of claim 1, wherein the sealing portion comprises a sealing surface that is configured to provide a seal with a portion of a gas turbine engine.

4. The turbine blade of claim 3, wherein a floor of the shelf is radially spaced from the sealing surface.

5. The turbine blade of claim 1, wherein the shelf does not extend from a leading edge of the blade to a trailing edge of the blade.

6. The turbine blade of claim 1, wherein a width of the groove is between 0.254-0.508 mm, and the depth of the groove is between 0.762-1.270 mm.

7. The turbine blade of claim 1, wherein the sealing portion terminates radially at sealing surface, and the groove is further configured to communicate a fluid from a position adjacent the shelf to a position adjacent the sealing surface.

8. The turbine blade of claim 7, wherein more than half of the fluid that enters the groove exits the groove at the position adjacent the blade tip trailing edge, and less than half of the fluid that enters the groove exits the groove and moves over a portion of the sealing surface.

9. The turbine blade of claim 1, wherein the depth of the shelf at the suction side of the blade is the same as the depth of the groove.

10. The turbine blade of claim 1, wherein the shelf is open on at least two sides.

11. A turbine blade, comprising:

a blade tip having a suction side and a pressure side, the blade tip extending from a leading edge portion of a blade to a trailing edge portion of the blade;

a shelf established in the pressure side of the blade tip and open to the pressure side of the blade tip; and a groove established in the blade tip configured to communicate fluid from the shelf to the trailing edge portion of the blade.

12. The turbine blade tip of claim 11, wherein the groove is a machined groove having a rectangular cross-section.

13. The turbine blade tip of claim 11, wherein the blade tip establishes a plurality of cooling holes having a diameter corresponding to a nonradial width of the groove.

14. The turbine blade tip of claim 11, wherein the width of the shelf is greater than the groove, and the shelf extends to an outermost pressure side surface of the blade tip.

15. The turbine blade tip of claim 11, wherein the blade tip comprises a sealing surface having a portion on a suction side of the groove and another portion on a pressure side of the groove.

16. The turbine blade of claim 11, wherein the shelf is established exclusively by distinct planar sidewalls and a floor, an inlet to the groove established within one of the sidewalls.

17. The turbine blade of claim 11, wherein the shelf is not a plenum.

18. The turbine blade of claim 11, wherein the shelf is open to at least one other side.

19. A method of cooling a blade comprising:

communicating a fluid through a blade to a blade shelf near a tip of the blade the blade shelf open to the pressure side of the blade;

moving a portion of the fluid across a portion of a blade tip sealing surface that extends from a blade tip leading edge to a blade tip trailing edge;

communicating another portion of the fluid from the blade shelf to a blade tip trailing edge within a groove that is established in the blade tip, and moving another portion of the fluid from the blade shelf from the groove to another portion of the blade tip sealing surface.

20. The method of claim 19, wherein a floor of the blade shelf extends to an outermost pressure side surface of the blade tip.

* * * * *